United States Patent [19]

Hartford et al.

[11] 4,276,600

[45] Jun. 30, 1981

[54] OXYGEN SENSOR FEEDBACK LOOP DIGITAL ELECTRONIC SIGNAL INTEGRATOR FOR INTERNAL COMBUSTION ENGINE CONTROL

[75] Inventors: Thomas W. Hartford, Livonia; James A. Kessler, Troy, both of Mich.

[73] Assignee: The Bendix Corporation, Southfield, Mich.

[21] Appl. No.: 881,981

[22] Filed: Feb. 27, 1978

[51] Int. Cl.[3] ..... F02M 51/00; F02D 28/00; F02B 75/10

[52] U.S. Cl. ..... 364/431; 60/276; 123/417; 123/438; 123/489

[58] Field of Search ..... 364/424, 431, 442; 235/92 TF; 60/276; 123/32 EA, 32 EE, 619 EC, 619 R

[56] References Cited

U.S. PATENT DOCUMENTS

| | | | |
|---|---|---|---|
| 3,467,821 | 9/1969 | Arp | 235/92 TF |
| 3,738,341 | 6/1973 | Loos | 123/119 R |
| 3,827,237 | 8/1974 | Linder et al. | 123/32 EA |
| 3,831,564 | 8/1974 | Schmidt et al. | 123/32 EA |
| 3,900,012 | 8/1975 | Wahl et al. | 123/32 EA |
| 4,088,095 | 5/1978 | Aono | 123/32 EE |
| 4,103,649 | 8/1978 | Matumoto et al. | 123/32 EE |
| 4,111,171 | 9/1978 | Aono et al. | 123/119 EC |
| 4,121,554 | 10/1978 | Sueishi et al. | 123/119 EC |
| 4,130,095 | 12/1978 | Bowler et al. | 123/32 EE |
| 4,135,381 | 1/1979 | Sherwin | 60/276 |

FOREIGN PATENT DOCUMENTS

| | | | |
|---|---|---|---|
| 2551639 | 6/1977 | Fed. Rep. of Germany | 123/32 EC |

*Primary Examiner*—Felix D. Gruber
*Attorney, Agent, or Firm*—Gaylord P. Haas, Jr.

[57] ABSTRACT

A method and apparatus for controlling the various functions of an internal combustion engine using a program-controlled microprocessor having a memory preprogrammed with various control laws and associated control schedules receives information concerning one or more engine-operating parameters such as manifold pressure, throttle position, engine coolant temperature, air temperature, and engine speed or period and the like. These parameters are sensed or measured and then the value thereof is supplied to input circuits for signal conditioning and conversion to digital words usable by the microprocessor. The microprocessor system computes digital control words indicative of particular computer-commanded engine control operations and output circuitry responds to predetermined computer-generated commands and to the computed digital command words for converting them into corresponding pulse-width control signals for controlling such engine operations as fuel-injection, ignition timing, proportional and/or on-off EGR control, and the like. The engine control system further includes an oxygen sensor feedback system for providing reliable data to said microprocessor for command control purposes. In particular the oxygen sensor signal is sampled a predetermined number of times per each engine revolution and the totality of each sampling is determined per revolution. This generates a digital word representing the condition of the air/fuel ratio of the engine over each revolution.

11 Claims, 2 Drawing Figures

*Oxygen System Integrator Circuitry*

Microprocessor-Based Electronic Engine Control System

Oxygen System Integrator Circuitry

OXYGEN SENSOR FEEDBACK LOOP DIGITAL ELECTRONIC SIGNAL INTEGRATOR FOR INTERNAL COMBUSTION ENGINE CONTROL

BACKGROUND OF THE INVENION

1. Field of the Invention

This invention relates generally to a method and apparatus for controlling an internal combustion engine and more particularly to a microprocessor-based electronic engine control system having a memory preprogrammed with various control laws and control schedules and being responsive to one or more sensed engine-operating parameters for generating signals for controlling engine functions such as fuel injection, ignition timing, EGR control, or the like.

2. Statement of the Prior Art

Many of the patents of the prior art recognize the need for employing the enhanced accuracy of digital control systems for more accurately controlling one or more functions of an internal combustion engine.

U.S. Pat. No. 3,969,614 which issued to David F. Moyer, et al on July 13, 1976 is typical of such systems as are U.S. Pat. No. 3,835,819 which issued to Robert L. Anderson, Jr. on Sept. 17, 1974; U.S. Pat. No. 3,904,856 which issued to Louis Monpetit on Sept. 9, 1975; and U.S. Pat. No. 3,906,207 which issued to Jean-Pierre Rivere, et al on Sept. 16, 1975. All of these Patents represent a break-away from the purely analog control systems of the past, but neither the accuracy, reliability, or number of functions controlled is sufficient to meet present day requirements.

Future internal combustion engines will require that emissions be tightly controlled due to ever-increasing governmental regulations, while fuel consumption is minimized and drivability improved over the entire operating range of the engine. None of the systems of the prior art provide a method and apparatus for controlling the operation of an internal combustion engine over even a substantial portion of its operating range with sufficient accuracy to minimize emissions and fuel consumption while simultaneously improving drivability.

The systems of the prior art have not normally attempted to use an oxygen sensor-based feedback system for control purposes due to the extreme difficulty in obtaining reliable data from existing oxygen sensors. Furthermore, the oxygen sensor signal processors of the prior art utilize dedicated electronic analog and digital integrators to implement particular control schemes destroying system flexibility while increasing cost and size considerations. Prior art attempts to use oxygen sensor systems with digital engine control systems have uncovered horrendous problems inherent in the sampling nature and processing speed requirements of current systems which still require that an integration of the oxygen sensor signal must be accomplished over one revolution external to the computer and none of the systems of the prior art have solved any of these problems to produce a reliable oxygen signals integrator for use with a microprocessor-based electronic engine control system.

The present invention avoids all of the problems of the prior art and employs an oxygen sensor feedback loop digital electronic signal integrator which can be used in conjunction with a microprocessor-based electronic engine control system for accurately determining air/fuel ratios existing in the exhaust systems of the engine and for performing precise engine control functions in response thereto to achieve a highly accurate and reliable closed-loop oxygen sensor-based digital control system for use with the engines of automobiles, other motor vehicles, and the like.

SUMMARY OF THE INVENTION

The system of the present invention employs one or more oxygen sensors which instantaneously monitor the air/fuel ratio existing in the exhaust system of an internal combustion engine. The sensor signal outputs are sampled at a predetermined rate and after one or more revolutions, the results of the sensor integration are saved and a new integration is begun. The latest integration is transferred to a microprocessor in response to a software-generated command and used in the microprocessor-controlled implementation of one or more program control laws for varying the computed engine control commands for achieving a desired air/fuel ratio.

In the method of the present invention, a plurality of sampling pulses are generated per each engine revolution. Each time a sample is made, a "one" count is accumulated in a counter for each sample that indicates a rich air fuel mixture while a "zero" count is stored each time a lean air/fuel ratio exists or visa versa. Therefore, a zero count would indicate a stoichiometric operation. The contents of the sensor counter are saved until sampled in response to a computer-controlled program-generated request for effecting one or more engine control operations in response to said preprogrammed control laws.

In the present system, the integration of a given oxygen sensor signal is accomplished by digital means utilizing a constant number of samples per engine revolution. The actual generation of the particular number of sampling pulses per engine revolution is done by digital logic. Negative numbers may be avoided by using "zero" counts that represent either a full "rich" or a full "lean" condition and "one" counts to represent the opposite or other of the "rich" or "lean" conditions and then integrating the "one's" condition or visa versa. There is no need for engine speed corrections for real time integrations due to the fact that the integration time base is varied by generating sampling pulses whose spacing is dependent upon engine speed and not upon real time.

INCORPORATION BY REFERENCE

This application is one of fourteen applications filed on Feb. 27, 1978, all commonly assigned and having substantially the same specification and drawings, the fourteen applications being identified below:

| Serial Number | Title |
|---|---|
| 881,321 | Microprocessor-Based Electronic Engine Control System |
| 881,322 | Feedback-Compensated Ramp-Type Analog to Digital Converter |
| 881,323 | Input/Output Electronic For Microprocessor-Based |

-continued

| Serial Number | Title |
|---|---|
| | Engine Control System |
| 881,324 | Switching Control of Solenoid Current in Fuel Injection Systems |
| 881,921 | Dual Voltage Regulator With Low Voltage Shutdown |
| 881,922 | Oxygen Sensor Qualifier |
| 881,923 | Ratiometric Self-Correcting Single Ramp Analog To Pulse Width Modulator |
| 881,924 | Microprocessor-Based Engine Control System Acceleration Enrichment Control |
| 881,925 | Improvements in Microprocessor-Based Engine Control Systems |
| 881,981 | Oxygen Sensor Feedback Loop Digital Electronic Signal Integrator for Internal Combustion Engine Control |
| 881,982 | Improvements in Electronic Engine Controls System |
| 881,983 | Electronic Fuel Injection Compensation |
| 881,984 | Ignition Limp Home Circuit For Electronic Engine Control Systems |
| 881,985 | Oxygen Sensor Signal Conditioner |

Figure 2:
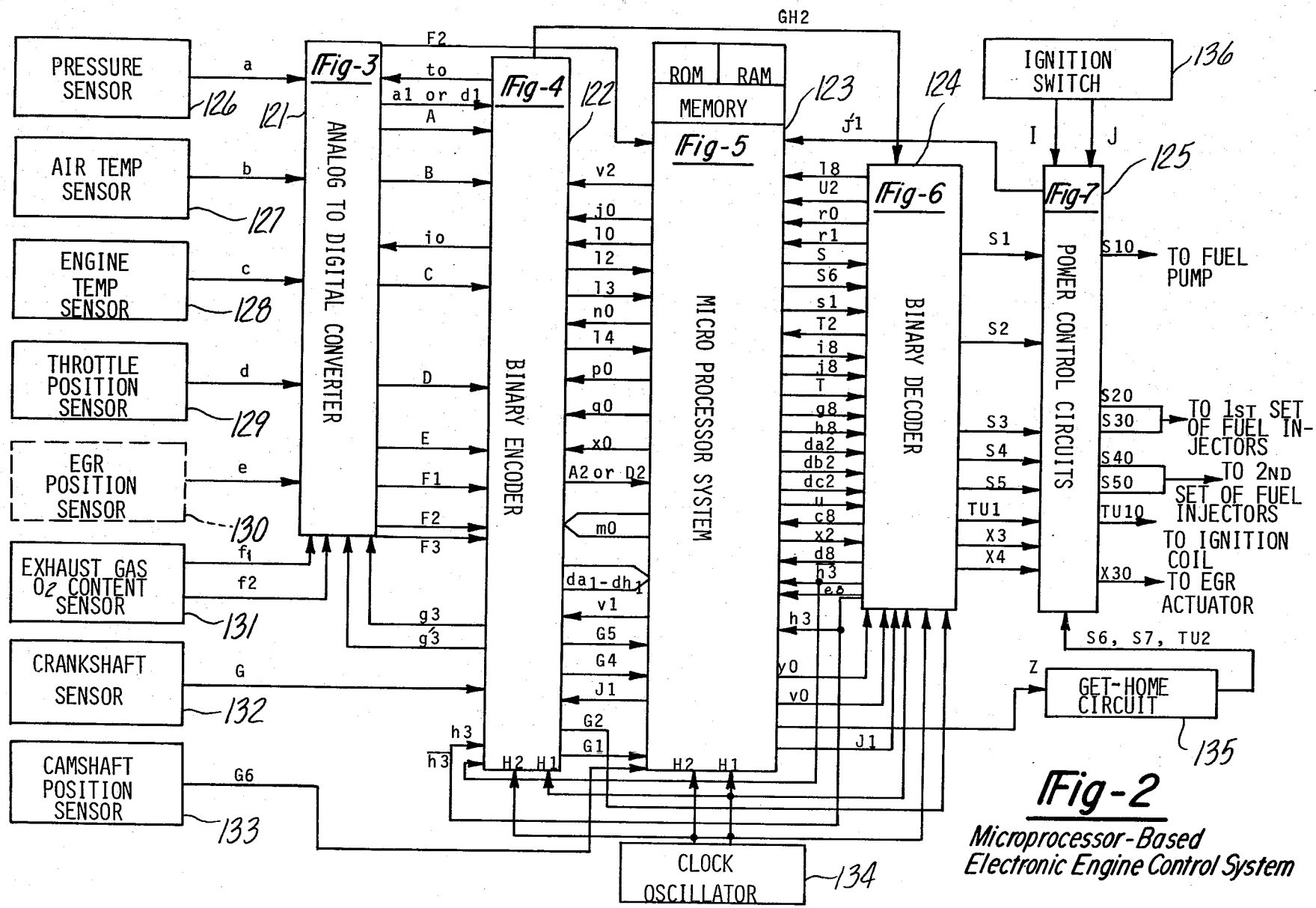
FIG. 2 is a block diagram of the microprocessor-based electronic engine control system.
Figure 4D:
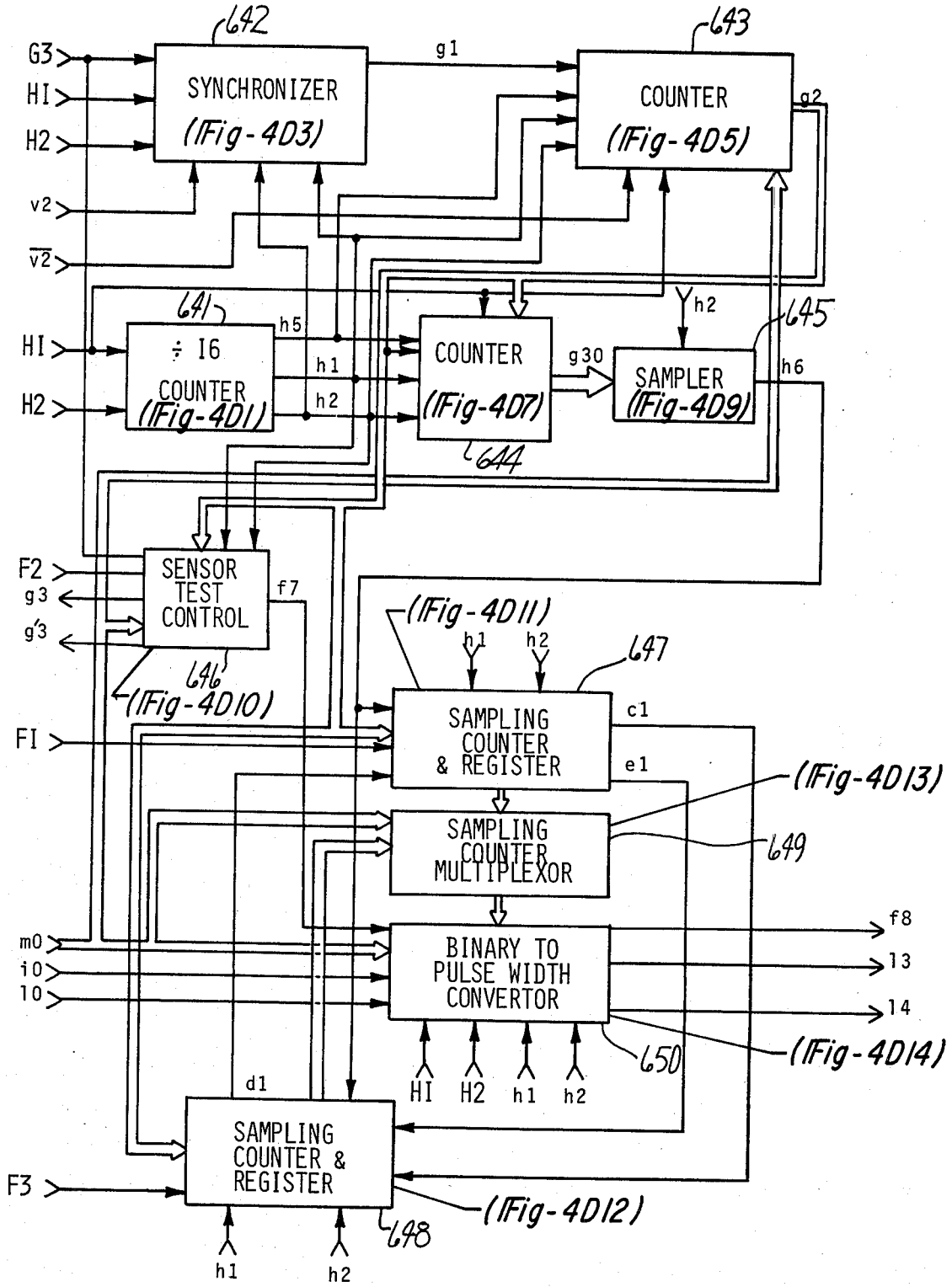
FIG. 4D is a block diagram of the oxygen system integrator circuitry.

Application Ser. No. 881,321, now U.S. Pat. No. 4,255,789 has been printed in its entirety and the specification of that application is specifically incorporated by reference. For a better understanding of the drawing figures in this applicaton, reference is made to the same figure numbers in the above mentioned application, Ser. No. 881,321 which includes FIGS. 1 to 10.34.

I claim:

1. In an internal combustion engine having an intake system, an exhaust system, an engine block, a plurality of cylinders disposed in the engine block, a piston mounted for reciprocal movement within each of the plurality of cylinders, means responsive to output control signals for controlling the quantity of fuel supplied to a selected one or more of the plurality of cylinders and the ignition of the fuel within the cylinders, the improvement comprising:

a microprocessor means including a memory means for storing a plurality of look-up tables of control values and one or more programmed control laws, said microprocessor means being responsive to data indicative of the actual measured value of various engine-operating parameters for implementing said control laws to compute one or more commands for generating the control signals;

oxygen sensing means disposed in said exhaust system for monitoring the air-fuel ratio existing in the cylinders and generating a sensor output signal indicative thereof, said sensor output signal having a first value if said air-fuel ratio is "rich" and a second value if said air-fuel ratio is not rich;

means for sampling said sensor output signal a predetermined number of times per engine period and temporarily storing an indication of the sampled values of said sensor output signal and;

means for counting the temporarily stored oxygen sensor sampled values by digital means and storing a digital count value indicative thereof until said digital count value is requested by said microprocessor means for use in implementing one or more of said pre-programmed control laws to compute one or more of said commands.

2. In an internal combustion engine system having an intake system, an exhaust system, an engine block, a plurality of cylinders disposed in the engine block, a piston mounted for reciprocal movement within each of the plurality of cylinders in response to the combustion of fuel and air therein, an output shaft operatively coupled to the pistons and rotatably driven by the reciprocal movement thereof within the plurality of cylinders, throttle means disposed at least partially within the intake system for controlling the flow of air into a selected one or more of the plurality of cylinders, means responsive to a fuel control signal for supplying a controlled quantity of fuel into the selected one or more of the plurality of cylinders, means responsive to an ignition control signal for selectively controlling the time and duration of ignition of said controlled quantities of air and fuel supplied to the selected one or more of said plurality of cylinders, sensor means for sensing a plurality of engine-operationg parameters, including sensor means for monitoring the rotation of the output shaft for determining predetermined reference points indicative of one or more particular points in the stroke of one or more of the pistons and hence in the rotational cycle of the engine and for outputting engine position pulses indicative of the rotational speed period of the engine, the sensor means further including oxygen sensor means disposed at least partially within the exhaust system for monitoring the air-fuel ratio existing in the cylinders and for generating an oxygen sensor output signal indicative of the air-fuel ratio, the oxygen sensor output signal having a first value whenever the air-fuel ratio is rich and a second value whenever the air-fuel ratio is not rich, computer means, memory means operatively coupled to the computer means for storing a plurality of look-up tables with modifier values which are functions of at least one of the plurality of engine-operating parameters, program means stored in said memory means for implementing at least one predetermined fuel control law when addressed by the computer means utilizing a sensed value of at least one of the engine-operating parameters or modifier values in the look-up table to calculate computer output command words, the program means also being addressable for generating a plurality of command signals, means responsive to the computer output command words for selectively varying at least the fuel control signal and the ignition control signal for controllably altering the air-fuel ratio existing in the engine, the improvement comprising a closed-loop, oxygen sensor-based feedback control system for automatically providing sufficiently reliable feedback information to enable the computer means to maintain a predetermined desired air-fuel ratio including:

means for sampling the value of the oxygen sensor output signal a predetermined number of times "A" per engine revolution;

means for digitally counting said sampled values over a second predetermined number of engine revolutions "B" to generate a binary count indicative of the average sampled value of the air-fuel ratio;

means for temporarily storing a binary count representing the result of a previously completed digital counting until a subsequent digital counting is completed and the initially stored binary number is replaced by the newly generated binary number representing the result of the latest digital count;

binary-to-pulse-width converter means responsive to a predetermined program-generated control signal for converting said binary number indicative of the result of said previously sampled oxygen sensor output signal values and temporarily stored in said temporary storage means into an oxygen sensor pulse-width signal indicative thereof and therefore indicative of the average measured air-fuel ratio existing in said exhaust system of the engine;

pulse-width-to-binary converter means for converting pulse-width signals indicative of various measured engine-operating parameters into a binary data word usable by said computer means and storing same until requested by a second predetermined program-generated command signal requesting that said binary data word to inputted into said computer means; and a time-shared multiplexer means responsive to a third predetermined program-generating command signal for selecting which one of said pulse-width signals indicative of the various engine-operating parameters is transmitted to said pulse-width-to-binary converter means for converting said pulse-width signal into a corresponding binary data word usable by the computer means, the computer means executing the program means to implement the at least one predetermined fuel control law utilizing the measured air-fuel ratio represented by said binary data word indicative thereof or modifier values computed by addressing one or more of the look-up tables utilizing said binary data word for computing a highly accurate self-correcting computer control word whose purpose is to restore and maintain a predetermined desired air-fuel ratio mode of operation within the engine.

3. The improved internal combustion engine system of claim 2 wherein said sampling means further includes:

clock means for generating a sequence of clock signals:

logic means responsive to said engine position pulses and said clock signals for generating X/2 properly-shaped engine position pulses synchronized to said clock signals per engine revolution, where X equals the number of cylinders in said internal combustion engine;

first counter means selectively presetable with a preprogrammed count depending upon the number of cylinders in said engine for counting said properly-shaped and synchronized engine position pulses and outputting one and only one engine period complete signal, one transfer signal and one clear signal per engine revoluton;

second counter means having "M" most significant bit stages and "N" least significant bit stages, said second counter means counting said clock signals to measure the engine period between successive engine period complete signals as a count number indicative thereof;

latching register means operatively coupled to the outputs of said "M" most significant bit stages of said second counter means and responsive to the outputting of said transfer signal for transferring the count then contained in said "M" most significant bit stages of said second counter means to corresponding stages of said latching register means and storing said transferred number indicative of the last measured engine period during the next successive engine period measurement count cycles;

an "M" stage downcounter means initially presetable with the number temporarily stored in the corresponding "M"0 stages of said latching register means, said downcounter beginning each count cycle by being preset with said latched number and then counting clock signals to decrement said preset number to zero, said downcounter means including logic means responsive to the detection of a zero count for generating a sampling signal and again presetting said downcounter means with said latched number such that said sampling signals are equally-spaced and are generated at a rate of exactly "A" times per revolution, where A equals $2^N$ times the length of the last measured engine period, and where "N" is the number of least significant bit stages of said second counter means.

4. The improved internal combustion engine system of claim 2 wherein said digital counting means includes a sampling counter initially cleared prior to said sampling period and responsive to the sampling of said oxygen sensor output signal "A" times per engine revolution for incrementing its count by "1" each time the value of said sampled oxygen sensor output signal is at the first level and for not incrementing its count each time the value of said sampled oxygen sensor output signal is at the second level such that the binary count stored in said sampling counter at the end of each engine revolution is representative of the average measured air-fuel ratio currently existing in the cylinders.

5. The improved internal combustion engine system of claim 4 wherein said means for temporarily storing said binary count includes a latching register operatively coupled to the outputs of said sampling counter for receiving and temporarily storing said binary count at the end of each of said engine periods and wherein said binary-to-pulse-width converter means includes a multiple stage comparator means having first and second inputs and a comparator output said first input of each of the stages of said comparator means being operatively coupled for receiving the outputs from corresponding stages of said latching register for transferring said stored binary count to said first set of comparator inputs, comparator counter means initially cleared at the start of each engine period for counting clock signals, the outputs of the stages of said comparator counter means being operatively coupled to the second inputs of corresponding stages of said comparator means, the output of said comparator means generating a pulse-width output signal indicative of the average measured air-fuel ratio, said pulse-width output signal beginning as soon as said comparator counter means begins counting said clock signals and ending as soon as the count attained by said comparator counter means presented to the second comparator inputs becomes equal to the transferred binary count from the latching register which was transferred to the first set of comparator inputs.

6. The improved internal combustion engine system of claim 2 wherein said oxygen sensor means includes first and second oxygen sensors operatively disposed in opposite banks of said exhaust system, wherein said digital counting means includes first and second sampling counters operatively coupled to said first and second oxygen sensors respectively, each of said first and second sampling counters being responsive to the receipt of a sampled oxygen sensor output signal at said first value for incrementing same and to the receipt of a sampled oxygen output sensor signal at said second value for not incrementing same such that the final binary count stored therein after said "A" sample times are taken and at the end of said engine period is indicative of the measured air-fuel ratio actually existing in the cylinders corresponding to the respective banks of said exhaust system averaged over a complete engine period, said means for temporarily storing includes first and second latching registers responsive to a transfer command for receiving said binary count attained in said first and second sampling counters, respectively, and for storing same until a subsequent digital counting is completed and transferred thereto, the program means addressed by said computer means for generating first and second computer request signals for requesting a conversion of the binary count stored in one of said first and second latching registers respectively, and logical gating means having inputs operatively coupled to the outputs of said latching registers and enabling inputs operatively coupled to receive one of said first and second computer request signals for programmably selecting which one of said binary counts stored in said respective first and second latching registers is to be transferred to said binary-to-pulse-width converter means for conversion into a pulse-width equivalent which can then be converted into a binary data word usable by the computer means by said pulse-width-to-binary converter means.

7. A closed-loop oxygen sensor-based feedback control system for controlling the air-fuel mixture in an internal combustion engine comprising:

oxygen sensor means operatively disposed with respect to the engine for sensing the actual air-fuel mixture existing therein and generating an oxygen sensor output signal having a first value if the air-fuel mixture is on one side of stoichiometric value and a second value if the air-fuel mixture is not on said one side of stoichiometric value;

means for generating one and only one engine period pulse per engine revolution;

means for generating clock pulses, means responsive to said engine period pulse for counting said clock pulses to measure the duration of an actual engine period between successive engine period pulses;

means operatively coupled to said counting means for generating a predetermined number of equally-spaced oxygen sensor sampling pulses for each engine revolution;

sampling counter means responsive to said sampling pulses for sampling the value of said oxygen sensor output signal for incrementing its count each time one of said first or second values is detected and not incrementing its count each time the other of said first and second values is detected such that at the end of said engine period, the count attained in said sampling counter means is indicative of the average air-fuel mixture existing in the engine;

means for temporarily storing said mixture indicative count while a new sampling period is in progress; and means responsive to said temporarily stored mixture count for selectively increasing and decreasing at least one of such engine-operating parameters such as fuel supply, and air supply, for affecting said air-fuel mixture so as to correct said air-fuel mixture and attempt to maintain stoichiometric operation.

8. In an internal combustion engine system having an intake system, an exhaust system, an engine block, a plurality of cylinders disposed in the engine block, a piston operatively mounted for reciprocal movement within each of the plurality of cylinders, rotational means operatively driven by the reciprocal movement of the pistons in response to the combustion of fuel and air in a selected one or more of the plurality of cylinders, means for supplying fuel and air into a selected one or more of the plurality of cylinders and igniting same to produce a given air-fuel ratio in the cylinders, sensor means responsive to the position of the rotational means for generating an engine position pulse once and only once each engine revolution, oxygen sensor means for monitoring the air-fuel ratio in the cylinders and generating an oxygen sensor output signal in response thereto, said oxygen sensor output signal having a first value if said air-fuel ratio is "lean" and a second value if said air-fuel ratio is not "lean", an electronic engine control means responsive to a data signal indicative of the average value of the actual air-fuel ratio existing in the cylinders for selectively increasing and decreasing the supply of at least one of said fuel and air to the selected one or more of the plurality of cylinders for controllably varying the air-fuel ratios so as to maintain a predetermined desired air-fuel ratio mode of operation, an improved closed-loop feedback control system comprising: means for sampling the value of said oxygen sensor output signal an exact predetermined number of times per engine revolution regardless of engine speed, means for counting said sampled values over a predetermined number of engine revolutions to obtain a count number indicative of the average measured air-fuel ratio and means for converting said count number indicative of the average of the actual measured means implementing a closed-loop feedback control of the air-fuel ratio in the engine.

9. In an internal combustion engine having an intake system, an exhaust sytem, an engine block, a plurality of cylinders disposed in said engine block, a piston operatively mounted for reciprocal motion within each of said plurality of cylinders, throttle means disposed at least partially within said intake system for controlling the flow of air therethrough, fuel injection means for controlling the quantity of fuel supplied into a selected one or more of said plurality of cylinders, an engine output shaft rotatably driven by the reciprocal movement of said pistons within said cylinders in response to the combustion of fuel and air within said cylinders, an electronic engine control system responsive to a digital word for selectively controlling at least one of said throttle means and aid fuel injection means to maintain an optimal air-fuel ratio in said engine, an improved closed-loop method of feedback control comprising the steps of:

measuring the actual air-fuel ratio in at least one of said intake system and generating an oxygen sensor output signal in response thereto, said oxygen sensor output signal having a first value if said air-fuel ratio is "lean" and the second value if said measured air-fuel ratio is not "lean";

sensing the rotational position of said engine output shaft for generating one and only one engine position pulse per engine revolution;

generating a predetermined exact number of equally spaced sampling pulses during each engine revolution regardless of engine speed and the like;

sampling the measured values of said oxygen sensor output signals with said predetermined number of equally spaced sampling pulses;

counting said sampled actual values of said oxygen sensor output signal to produce a first number indicative of the average value of said measured air-fuel ratio over a predetermined number of engine revolutions; and then converting said first number indicative of the average value of said measured air-fuel ratio over a predetermined number of engine revolutions into said digital word for enabling said electronic engine control system to controllably vary at least one of such engine-operative parameters as the position of said throttle means, the quantity of fuel supplied by said fuel injector means, and the like so as to selectively increase and decrease the air-fuel ratio to maintain said predetermined optimal air-fuel ratio mode of engine operation.

10. A method for controlling the operation of an internal combustion engine so as to maintain a predetermined desired air-fuel ratio comprising the steps of measuring the actual air-fuel ratio existing in said engine, generating a predetermined number of equally-spaced sampling signals as a function of engine speed, sampling the measured values of air-fuel ratio each time one of said sampling signals is generated, integrating said sampled measured values of actual air-fuel ratio over a predetermined number of engine revolutions to compute an average measured air-fuel ratio, and selectively increasing and decreasing various engine-operating parameters affecting said air-fuel ratio in accordance with said integrated value indicative of the average actual air-fuel ratio to maintain a closed loop feedback control of the operation of said internal combustion engine so as to maintain said predetermined desired air-fuel ratio.

11. In a computer-based engine control system responsive to various computer-usable data words for producing program-generated commands controlling at least one of the quantity of fuel and air supplied to said engine for combustion purposes, a method of oxygen sensor feedback control of the air-fuel ratio existing within said engine comprising the steps of:

measuring the actual air-fuel ratio existing in said engine;

generating a digital oxygen sensor output signal whose value is indicative of at least one of a "rich" or "lean" air-fuel mixture;

sampling said generated digital oxygen sensor output signal with a predetermined number of equally-spaced sampling signals as a function of engine speed;

integrating said sampled values of said digital oxygen sensor output signal over at least one engine revolution to generate a binary number indicative of the average measured air-fuel ratio;

converting said binary number indicative of the average measured air-fuel ratio into a computer-usable data word indicative thereof; and programmably generating additional commands utilizing said data word indicative of the average measured air-fuel ratio for controlling the increase and decrease of at least one of the quantity of fuel and the quantity of air supplied to said engine to restore and maintain a predetermined desired air-fuel ratio in said engine.

* * * * *